US006014953A

United States Patent [19]

Vreeland

[11] Patent Number: 6,014,953

[45] Date of Patent: Jan. 18, 2000

[54] ROTARY SPARK IGNITED INTERNAL COMBUSTION ENGINE

[76] Inventor: Thomas A. Vreeland, 5861 Geddes Rd., Ypsilanti, Mich. 48198

[21] Appl. No.: 08/878,003

[22] Filed: Jun. 18, 1997

Related U.S. Application Data

[60] Provisional application No. 60/020,101, Jun. 19, 1996.

[51] Int. Cl.[7] ..... F02B 53/00

[52] U.S. Cl. ..... 123/246

[58] Field of Search ..... 123/246; 418/206

[56] References Cited

U.S. PATENT DOCUMENTS

| | | | |
|---|---|---|---|
| 1,155,335 | 10/1915 | Bricknell et al. | 123/246 |
| 1,704,236 | 3/1929 | Zuccarello et al. | 123/246 |
| 4,003,349 | 1/1977 | Lothringen | 123/246 |

FOREIGN PATENT DOCUMENTS

| | | | |
|---|---|---|---|
| 919819 | 12/1946 | France | 123/246 |
| 3101600 | 8/1983 | Germany | 123/246 |

*Primary Examiner*—Michael Koczo
*Attorney, Agent, or Firm*—James M. Deimen

[57] ABSTRACT

A rotary internal combustion engine comprises a pair of rotors having a plurality of vanes that intermesh and are located in a single stationary chamber. A central intake conduit provides fresh air upstream of the intermeshing vanes. The air is compressed into a combustion volume wherein the air stream divides and fuel is injected into each air stream. An ignitor in each combustion volume causes the fuel air mixture to combust and expand against the vanes of the rotors. The spent mixture of each stream exhausts through a separate conduit. A portion of the fresh air is trapped between the vanes of each rotor and therefore bypasses the combustion volume. This fresh air remixes with the burning fuel air mixture to provide a lean burn as the gases expand against the vanes and then exhaust. The intermeshing vanes are sized to provide very close proximity of vane tips to roots without physical contact to thereby provide a substantially sealing engagement without rubbing. Similarly, the vane tips engage chamber walls without contact but with close proximity.

3 Claims, 3 Drawing Sheets

ROTARY SPARK IGNITED INTERNAL COMBUSTION ENGINE

This application is a complete application based on provisional patent application Ser. No. 60/020101 filed Jun. 19, 1996.

BACKGROUND OF THE INVENTION

The field of the invention pertains to internal combustion engines, and in particular, to rotary vaned engines of the intermittent or continuous combustion types.

A variety of rotary internal combustion engines have been developed wherein a rotary device compresses air, the compressed air is injected with fuel, the mixture ignited by a spark or flame front, and the hot gases allowed to expand against a rotary device to produce useful mechanical power.

SUMMARY OF THE INVENTION

The new rotary internal combustion engine comprises a pair of rotors having a plurality of vanes, preferably twelve, that intermesh and are located in a single stationary chamber. A central intake conduit provides fresh air upstream of the intermeshing vanes. The air is compressed into a combustion volume wherein the air stream divides and fuel is injected into each air stream. An ignitor in each combustion volume causes the fuel air mixture to combust and expand against the vanes of the rotors. The spent mixture of each stream exhausts through a separate conduit. A portion of the fresh air is trapped between the vanes of each rotor and therefore bypasses the combustion volume. This fresh air remixes with the burning fuel air mixture to provide a lean burn as the gases expand against the vanes and then exhaust. The intermeshing vanes are sized to provide very close proximity of vane tips to roots without physical contact to thereby provide a substantially sealing engagement without rubbing. Similarly, the vane tips engage chamber walls without contact but with close proximity. Modern manufacturing methods allow very close tolerances that, in turn, allow very small clearances between moving parts and stationary parts for an effective sealing effect.

DESCRIPTION OF THE PREFERRED EMBODIMENTS

Figure 1:
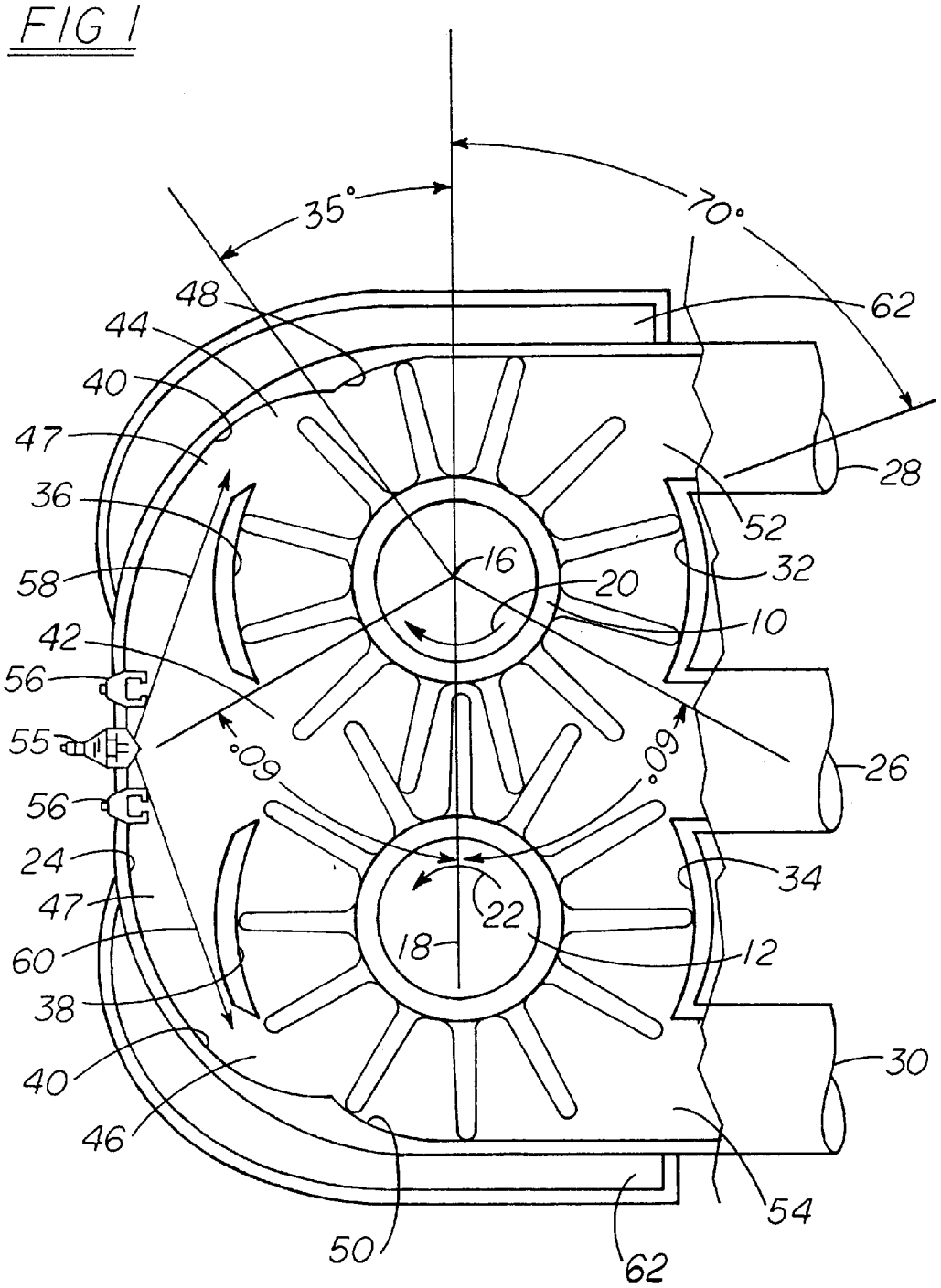
FIG. 1 is a schematic side view of a twin rotor version of the new engine.

Illustrated in FIG. 1 is a pair of rotors 10 and 12 each having twelve vanes 14 extending therefrom. The vanes 14 are generally slender in profile and 30° apart about the shaft axes 16 and 18 of each rotor 10 or 12. The vane 14 height from the root is one-quarter of the rotor diameter. The rotor vanes 14 intermesh as shown and rotate as indicated by the arrows 20 and 22. Although the number of vanes 14 shown is twelve, rotors with 10–14 vanes may be employed.

The rotors 10 and 12 are located in a chamber 24 having an inlet conduit 26 to supply air to the chamber and a pair of exhaust conduits 28 and 30. Within the chamber 24 the chamber walls 32 and 34 between the inlet conduit 26 and the exhaust conduits 28 and 30 are shaped for close proximity with the tips of the vanes 14. Opposite the chamber walls 32 and 34 are a pair of similarly shaped baffles 36 and 38 also for close proximity with the tips of the vanes 14. The close proximity of the vane tips provides negligible back flow of air without metal to metal sliding contact.

The baffles 36 and 38 in combination with the inside wall 40 of the chamber 24 form an inlet port 42 and a pair of outlet ports 44 and 46 for communication with a combustion chamber portion 47 of the chamber 24. Beyond the outlet ports 44 and 46 the chamber 24 wall is also shaped for close proximity at 48 and 50 with the tips of the vanes 14. The chamber walls at 48 and 50 extend 35° and in combination with the chamber walls 32 and 34 respectively form exhaust ports 52 and 54. As shown these exhaust ports 52 and 54 each extend over a 65°–70° arc.

The baffles 36 and 38 in combination with the inside wall 40 form a combustion region having a fuel injection nozzle 55 and a pair of ignitors 56 to either side of the nozzle 54. As indicated by arrows 58 and 60 the fuel spray is bifurcated to provide combustion and hot gases leading to both outlet ports 44 and 46. The spray patterns are 80° wide in planes perpendicular to the view. The relatively rich burning gas mixture combines with fresh air between the vanes 14 to both drive the rotation of the rotors 10 and 12 and to form a lean burn mixture of combustion gases for pollution control.

For most applications the chamber 24 is surrounded by water cooling passages 62. As an alternative the chamber 24 may be equipped with cooling fins for air cooling of the engine.

To assure that the rotor vanes 14 properly mesh a pair of inter-engaging gears (not shown) external to the chamber 24 and mounted on the shafts 16 and 18 on the rotors 10 and 12 constrain the rotational movement of the rotors for proper vane meshing. These gears may be spur gears or helical gears manufactured for high resistance to wear, negligible backlash and quiet operation at all speeds. The gears are keyed to the respective shafts with an interference fit.

Figure 2:
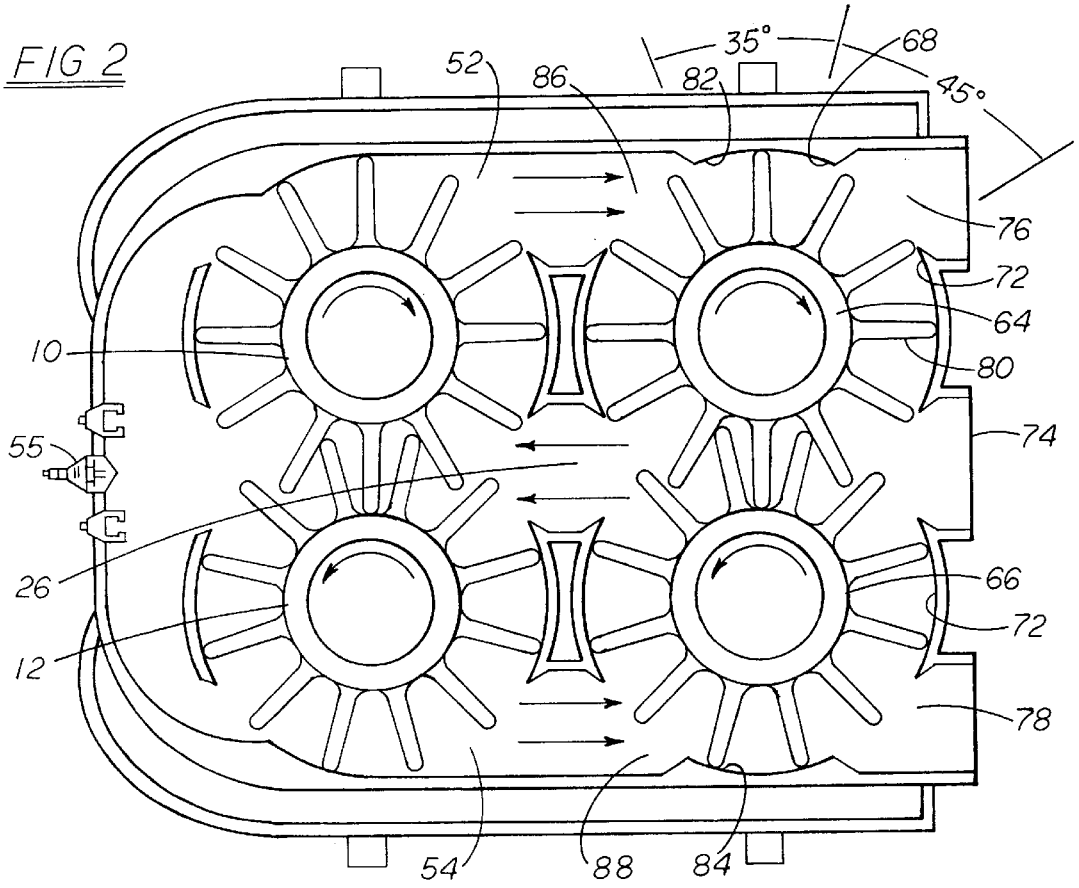
FIG. 2 is a schematic side view of a quadruple rotor version of the new engine.

Illustrated in FIG. 2 is a modification of the engine that includes a second pair of rotors 64 and 66 which boost the inlet pressure of the incoming air and are driven by the exhaust gases. The second pair of rotors 64 and 66 intermesh upstream of the inlet conduit 26 and are driven by exhaust gases exiting the exhaust ports 52 and 54. The second pair of rotors 64 and 66 also include a second pair of inter-engaging spur or helical gears (not shown) external to the second chamber 68 which contains the second pair of rotors. The second pair of rotors 64 and 66 preferably revolve at a higher rotational speed than the first pair of rotors 10 and 12. The relative rotational speeds may be positively controlled by a gear train or toothed belt interconnecting the two pairs of rotors. Alternatively, the interconnection may be through a variable speed drive train such as a Reeves drive.

As above the chamber 68 walls 70 and 72 between the inlet port 74 and the outlet ports 76 and 78 are shaped for close proximity to the vane 80 tips to reduce back flow to negligible amounts. Similarly, the chamber walls 82 and 84 are likewise shaped for close proximity to the vane 80 tips. The chamber walls 82 and 84 extend 35° from the exhaust inlet ports 86 and 88 to the outlet ports 76 and 78. The outlet ports 76 and 78 extend over 45° arcs. The inlet port 74 remains the same in extent as the inlet conduit 26.

In operation of the engine the second pair of rotors 64 and 66 are driven at least 30% faster than the first pair of rotors 10 and 12, however, the top rotational speed of the rotors is limited only by the strength of the hub and vane materials of the rotors and inertia effects of the air volumes passing through the engine.

Figure 3:
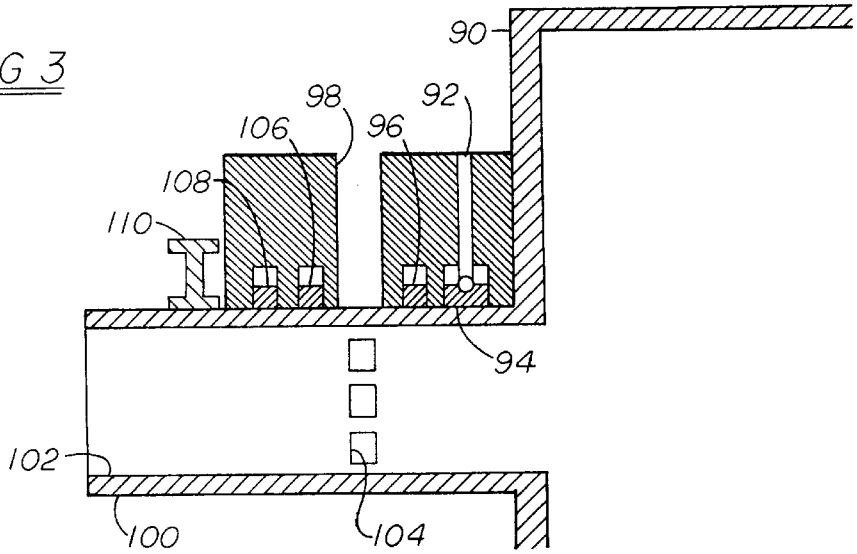
FIG. 3 is a schematic partial cutaway view of a rotor hub and shaft.

In FIG. 3 a rotor 90 is shown with an oil duct 92 leading to an oil bearing 94. Adjacent the oil bearing 94 is a water seal 96 and a water duct 98. The shaft 100 of the rotor 90 is hollow 102 and includes water ports 104 aligned with the water duct 98. A second water seal 106 is located to the other side of the water duct 98 as is an oil seal 108 and an intermeshing gear 110. This configuration provides for water cooling of the rotor 90 internally, since as a continuous combustion engine the rotor 90 is expected to reach high temperatures and the vanes need to be cooled from within the rotor 90.

In an air cooled version of the engine for maximum operating temperatures the rotors may be manufactured from refractory alloys or whisker reinforced ceramic and have air cooling passages in the vanes similar to the blades in Brayton cycle gas turbine engines.

Figure 4:
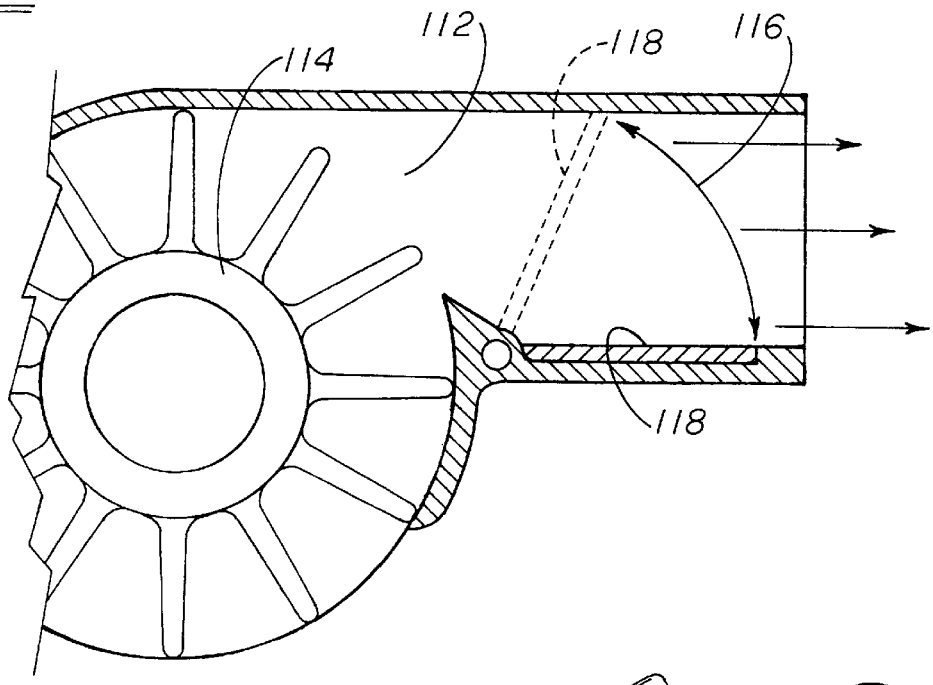
FIG. 4 is a partial cutaway side view of a rotor and exhaust valve.

In FIG. 4 an outlet 112 from a rotor 114 is illustrated with an optional engine braking control 116. The engine braking control 116 comprises a flapper valve 118 which can adjust the flow of pumping gases through the engine during braking when the engine is used in a vehicle for example. When the flow of gases through the engine is reduced the effective braking is reduced, however, if the flapper valve 118 is fully shut for more than a moment the engine will flame out and need to be restarted with a fresh charge of air.

Figure 5:
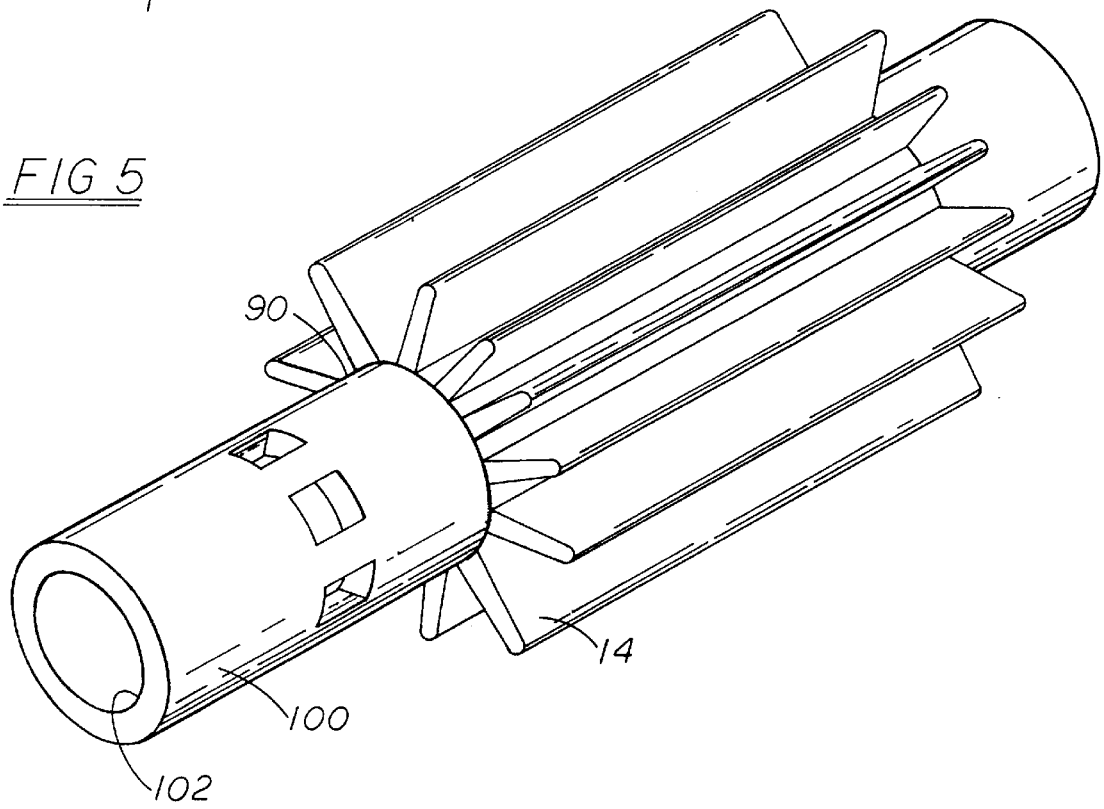
FIG. 5 is a perspective view of a rotor and shaft for the new engine.

In FIG. 5 a perspective of a rotor 90 is shown with the hollow 102 shaft 100 and water ports 114. The relatively thin tapered vanes 14 extend a considerable length axially along the rotor to each side wall to maximize the volume contained between the vanes and to maximize the volume to side wall ratio.

Although one fuel injector 55 is shown, there may be additional injectors along the length of the combustion chamber 47. And for high speed engines additional ignitors may also be employed. Both the injectors 55 and ignitors operate continuously for continuous combustion and a smooth turbine like output of power and torque. Engine power is controlled by the rate of fuel supplied to the injectors 55. In addition, a throttle may be employed in the inlet conduit 26 to further adjust the power output of the engine.

I claim:

1. An internal combustion engine comprising a chamber and a pair of vaned rotors within the chamber, said vaned rotors mounted for rotation about parallel axes and spaced for intermeshing of the vanes as the rotors rotate, a combustion chamber to one side of the rotors and within the chamber, a pair of baffles separating the combustion chamber from the rotors and forming an inlet port to the combustion chamber and a pair of outlet ports from the combustion chamber, an inlet conduit positioned to direct inlet air at the intermeshing vanes of the rotors and the outlet ports positioned to direct combustion gases at vanes spaced from the intermeshing vanes.

2. The internal combustion engine of claim 1 wherein a portion of the inlet air bypasses the combustion chamber by remaining between the vanes and recombining with the combustion gases at the vanes spaced from the intermeshing vanes.

3. The internal combustion engine of claim 2 including a second pair of rotors positioned with intermeshing vanes intercepting inlet air from the inlet conduit and intercepting combustion gases at vanes spaced from the intermeshing vanes.

* * * * *